US006817219B2

(12) United States Patent
Pollkoetter

(10) Patent No.: US 6,817,219 B2
(45) Date of Patent: Nov. 16, 2004

(54) FLOSPINNING METHOD AND DEVICE FOR CARRYING OUT FLOSPINNING

(75) Inventor: Guenter Pollkoetter, Beckum (DE)

(73) Assignee: Leico GmbH & Co. Werkzeugmaschinenbau, Ahlen (DE)

( * ) Notice: Subject to any disclaimer, the term of this patent is extended or adjusted under 35 U.S.C. 154(b) by 120 days.

(21) Appl. No.: 10/239,214

(22) PCT Filed: Nov. 8, 2001

(86) PCT No.: PCT/EP01/12946

§ 371 (c)(1),
(2), (4) Date: Jan. 14, 2003

(87) PCT Pub. No.: WO02/053307

PCT Pub. Date: Jul. 11, 2002

(65) Prior Publication Data

US 2004/0034980 A1 Feb. 26, 2004

(30) Foreign Application Priority Data

Jan. 4, 2001 (DE) ..... 101 00 200
Mar. 30, 2001 (DE) ..... 101 15 815

(51) Int. Cl.[7] ..... B21D 22/00

(52) U.S. Cl. ..... 72/85; 72/83; 72/8.9; 72/11.6; 72/370.01; 700/171

(58) Field of Search ..... 72/8.3, 8.4, 8.9, 72/11.6, 12.7, 12.8, 82, 83, 84, 85, 370.01; 700/148, 171; 29/407.05

(56) References Cited

U.S. PATENT DOCUMENTS 3,839,892 A 10/1974 Andriessen
3,992,911 A 11/1976 Connell et al.
5,323,630 A * 6/1994 Wenzel et al. ..... 72/83
5,699,690 A * 12/1997 Furugen et al. ..... 72/69
5,775,151 A * 7/1998 Massee ..... 72/10.4

FOREIGN PATENT DOCUMENTS

DE 152 491 12/1981
DE 34 02 301 8/1985

* cited by examiner

*Primary Examiner*—Ed Tolan
(74) *Attorney, Agent, or Firm*—Oblon, Spivak, McClelland, Maier & Neustadt, P.C.

(57) ABSTRACT

A flow-forming method and apparatus, in which a blank is placed on a rolling mandrel of a flow-forming machine, the blank is rotated relative to at least one flow-forming roll, the at least one flow-forming roll is infed radially and/or axially relative to the blank, and the blank is axially lengthened by the flow-forming roll and flow-formed to a workpiece. The method and apparatus compensate dimensional variations of the blank by working at least one compensating area into the workpiece, determining, before and/or during flow-forming, geometrical data of the blank and/or workpiece with a measuring device, obtaining a desired final geometry of the workpiece by individually calculating the geometrical parameters of the at least one compensating area as a function of the geometrical data determined, and controlling the infeed of the flow-forming roll in accordance with the calculated geometrical parameters of the compensating area, so that a workpiece with the desired final geometry can be formed independently of dimensional variations of the blank.

16 Claims, 6 Drawing Sheets

FLOSPINNING METHOD AND DEVICE FOR CARRYING OUT FLOSPINNING

Figure 1:
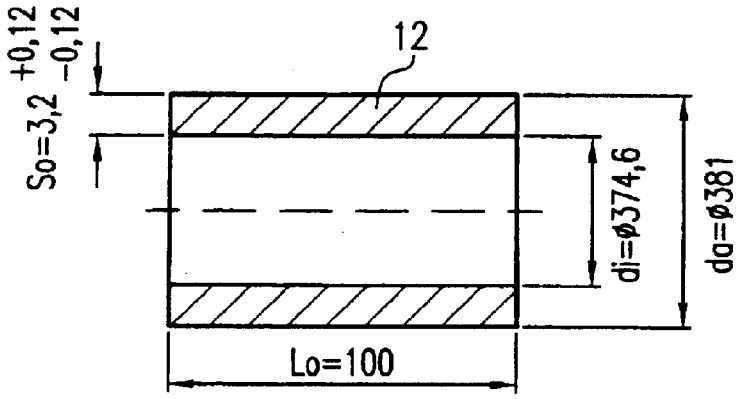

This application is a 35 USC 371 of PCT/EP01/12946 filed Nov. 08, 2001.

The invention relates to a flow-forming method according to the preamble of claim 1 and to a flow-forming apparatus according to the preamble of claim 10.

In a flow-forming method according to the preamble a blank is placed on a rolling mandrel of a flow-forming machine, the blank is rotated relative to at least one flow-forming roll, the at least one flow-forming roll is infed relative to the blank and the blank is axially lengthened by the flow-forming roll and flow-formed to a workpiece.

A flow-forming method according to the preamble is known from DE-A-34 02 301. In said method radial, axial and tangential force components can be measured on the flow-forming or spinning roll. The measured values determined are used for regulating the flow-forming process.

A flow-forming apparatus according to the preamble has a rolling mandrel for receiving a workpiece, at least one flow-forming roll, a drive device for producing a rotation between the workpiece and the roll and a control device for controlling an infeed in relative manner between the rolling mandrel and the flow-forming roll.

The rolling mandrel can be driven in rotary manner and the flow-forming roll can be infed radially and/or axially to the workpiece. However, it is also possible for a flow-forming roll or a plurality of such rolls driven in rotary manner and arranged on a ring driven in rotary manner, to be radially and/or axially infed to a fixed or also rotating rolling mandrel.

Such flow-forming methods and apparatuses are known and are e.g. used for cylinder flow-forming of rotationally symmetrical precision tubular components.

These known methods are more particularly characterized by economic advantages, which is essentially due to the fact of the material saving as a result of non-cutting working, in the strain hardening of the material during working and in the considerably shortened manufacturing times compared with cutting methods. In addition, such methods make it possible to produce numerous outer circumferential shapes, e.g. contour offsets or shoulders, transition radii and conical areas.

In the case of cylinder flow-forming it is possible to obtain wall thickness tolerances of a few hundredths of a millimetre. However, the cylindrical blanks normally used generally have thickness tolerances of several tenths of a millimetre. As a result of the individually differing thickness of the blanks and due to the volume constancy of the material to be worked, considerable geometrical differences, particularly length differences occur on the manufactured part. It is therefore necessary to use further machining steps, particularly finishing by cutting. This leads to a considerable rise in the machine, personnel, time and material costs and therefore the costs of the finished precision components.

The object of the invention is to provide a method and an apparatus enabling the manufacture of particularly high precision workpieces.

This object is achieved by a method having the features of claim 1 and an apparatus having the features of claim 10.

Preferred further developments of the method according to the invention and advantageous embodiments of the apparatus according to the invention are claimed in the subclaims.

According to the invention, a method of the aforementioned type is further developed in that for compensating dimensional variations of the blank at least one compensating area is formed into the workpiece, that before and/or during flow-forming geometrical data of the blank and/or workpiece are determined with a measuring device, that for obtaining a desired final geometry of the workpiece the geometrical parameters of the at least one compensating area are individually calculated as a function of the geometrical data determined and that by means of a control device the infeeding of the flow-forming roll is controlled in accordance with the calculated geometrical parameters of the compensating area, so that independently of dimensional variations of the blank it is possible to form a workpiece having the desired final geometry.

The essence of the invention is that, as a function of the specifically existing dimensional variation, each blank is individually manufactured. For this purpose, according to the invention, before and/or during flow-forming specific geometrical data of the blank and/or workpiece are determined. On the basis of said geometrical data an individual compensating area is then worked into the workpiece. This can bring about the decisive advantage that, independently of any dimensional variations of the blank, the workpiece always has a desired final geometry.

Another important advantage is that with the method according to the invention it is possible to manufacture workpieces with such a high precision, that there is no need for subsequent machining steps, particularly cutting finishing operations. This permits significant savings in time, personnel and machine costs.

According to a preferred development of the method, the at least one compensating area is worked into an area of the workpiece not critical for the functionality thereof. This can bring about the advantage that the functionality of workpieces is maintained, independently of how the compensating area is in each case individually formed.

As geometrical data preferably at least one axial length of the blank and/or workpiece is determined, particularly several times. As the workpiece wall thickness on rolling out is usually significantly reduced, i.e. the workpiece is significantly lengthened, the axial length is sensitively dependent on any blank dimensional variations present, so that as a result of this quantity the geometrical parameters of the compensating area can be very precisely determined.

With the aid of suitable path measuring systems, whose measured data are processed by a main frame computer, according to the invention it is possible to control wall thickness tolerances occurring during the manufacturing process.

As geometrical data it is also possible to determine a diameter and/or a wall thickness of the blank and/or workpiece. This makes it possible to increase the precision of determining the parameters of the compensating area.

Besides the geometrical data further measurements can be performed on the blank and/or workpiece. For example, before, during and/or after flow-forming a workpiece temperature can be determined.

In addition, during flow-forming, it is possible to determine a pressure in the workpiece, particularly in the axial direction.

The specific geometry of the workpiece is sensitively dependent on the pressure and temperature, so that a recording of these parameters allows a further increase in the precision of manufacture.

Preferably the temperature and/or pressure determined are supplied to the computer means and are included in the calculation of the geometrical parameters of the compensating area.

In a preferred variant of the method according to the invention, the compensating area is formed as a cylindrical area and/or as at least one bevelled area. These forms can firstly be produced in a simple manner on a flow-forming machine and in addition the geometrical parameters of these forms can be calculated particularly easily.

As a function of the workpiece design, it is possible to implement other, randomly shaped compensating areas.

If the dimensional variations of the blank are particularly large, it is possible to work several compensating areas into the workpiece. This can also be advantageous if it is desired that the variation between the geometrical parameters of a compensating area between individual workpieces is not to be too large.

The method according to the invention can be performed as down-feed and also up-feed methods.

An apparatus of the aforementioned type is inventively further developed in that at least one measuring device is provided for determining the geometrical data of the workpiece, that the measuring device is linked to a computer means, which is designed for calculating the geometrical parameters of a compensating area, which is worked into the workpiece for individually compensating dimensional variations of the blank and that by means of the control device the infeed of the flow-forming roll is controllable, so that the compensating area of the workpiece is constructed as a function of the geometrical parameters individually calculated by the computer means.

The apparatus, which can also be referred to as a flow-forming machine, can be operated in path-controlled and/or pressure-controlled manner. With the aid of NC technology, it is possible to implement path-giving flow-forming operations and the exact positioning of the flow-forming rolls in the longitudinal and transverse axis.

The measuring device preferably has at least one displacement transducer. These can be of an optical or acoustic nature and/or in the form of a sensor for determining the electrical conductivity.

In an advantageous development of the inventive apparatus several displacement transducers are provided and are in particular arranged in axially spaced manner. This advantageously allows a multiple determination, e.g. of an axial length of the workpiece during the flow-forming method.

In order to increase the information base for calculating the geometrical parameters of the compensating area, it is also possible for the measuring device to have a sensor for determining the diameter of the workpiece and/or a wall thickness of the workpiece.

In addition, measuring devices or sensors can be provided for determining further physical quantities, so that the workpiece can be even more precisely characterized and the manufacturing process can be performed under even better defined conditions.

For example, for determining a temperature of the workpiece, it is possible to provide a temperature sensor, or for determining a pressure in the workpiece, particularly in an axial direction, a pressure sensor can be provided.

Further features, characteristics and advantages of the method and apparatus according to the invention are explained hereinafter with the aid of the diagrammatic drawings, wherein show:

FIG. 1 An axial cross-sectional view of a blank.

Figure 2:
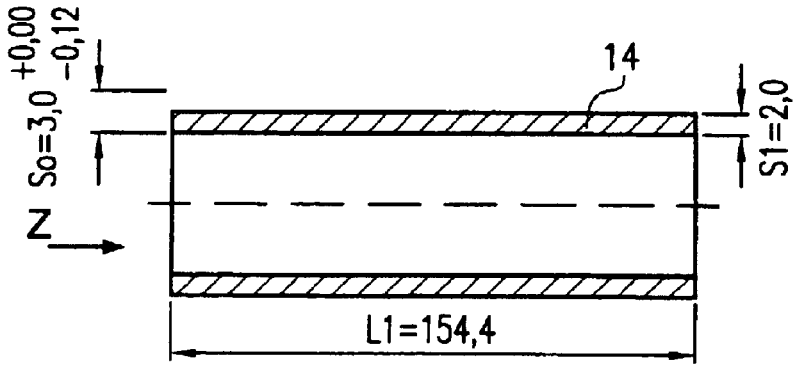
Figure 3:
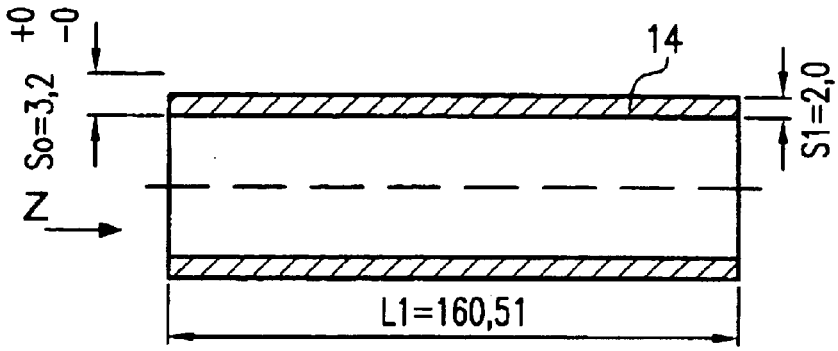
Figure 4:
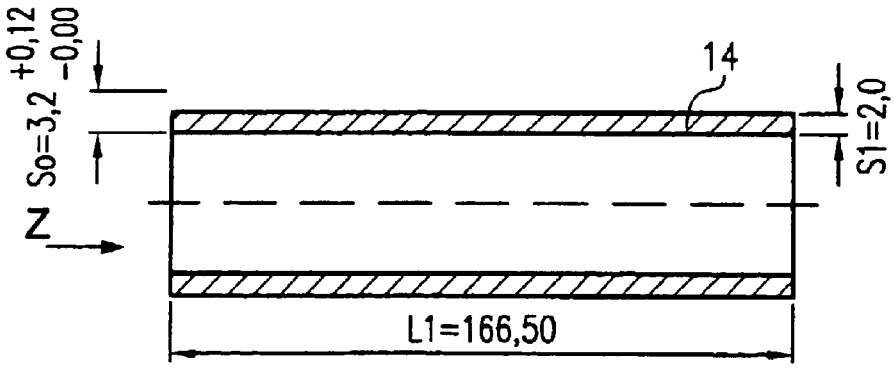

FIGS. 2 to 4 Axial cross-sectional views of workpieces, flow-formed from blanks with different dimensional variations.

Figure 5:
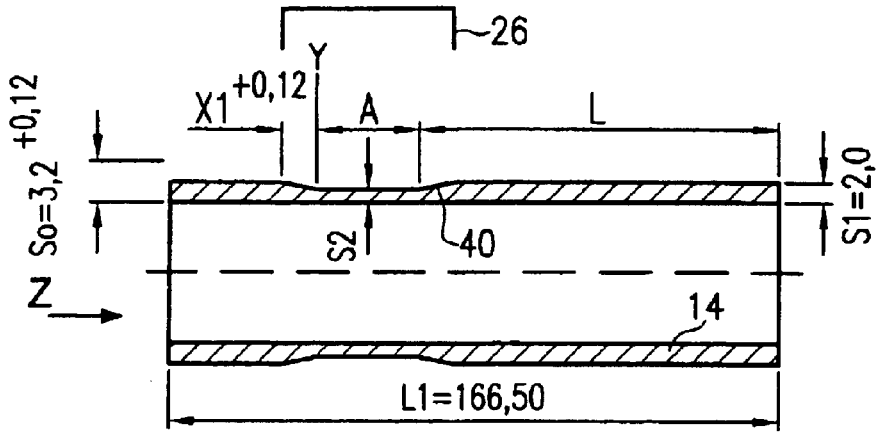
Figure 6:
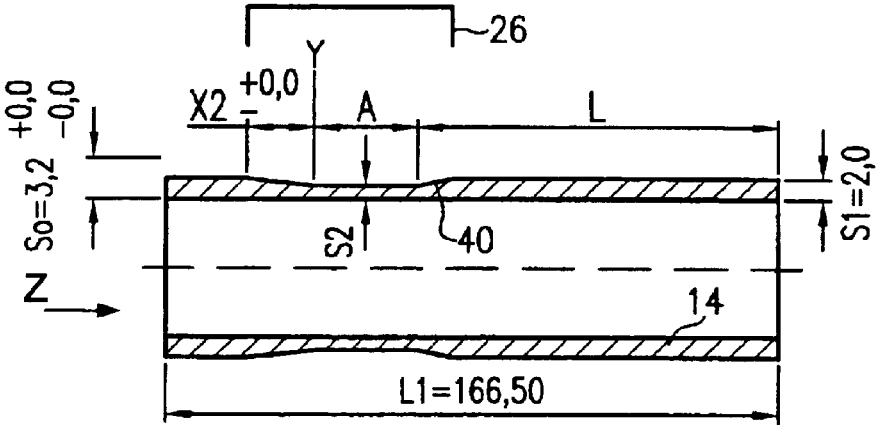
Figure 7:
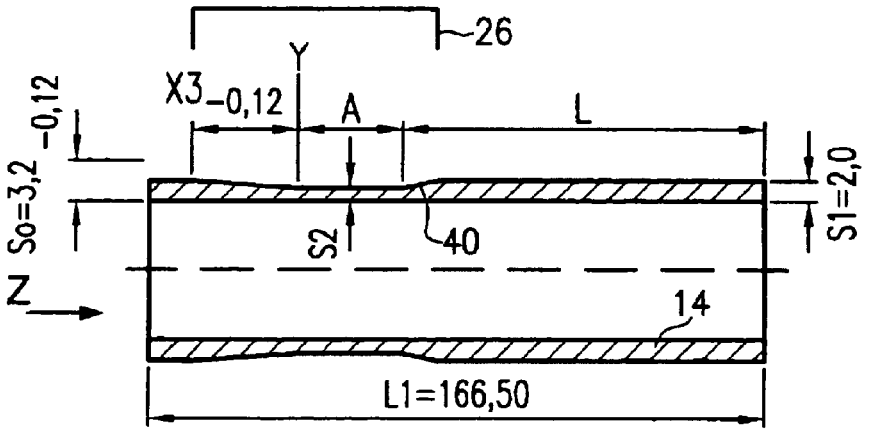

FIGS. 5 to 7 Axial cross-sectional views of workpieces with individually formed compensating areas.

Figure 8:
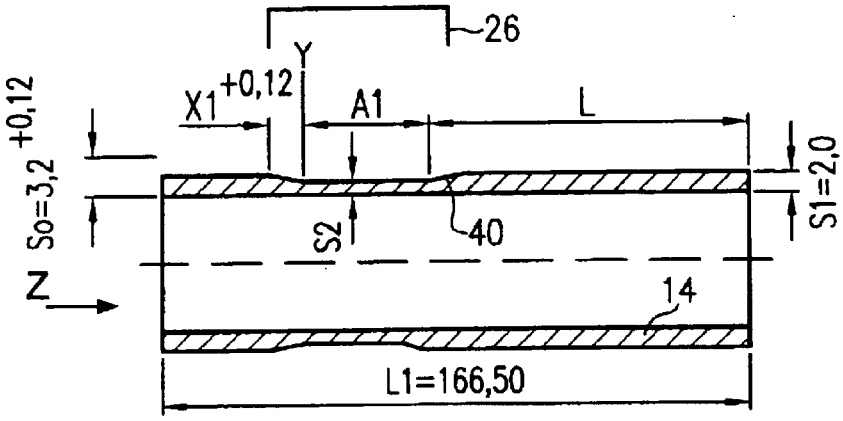
Figure 9:
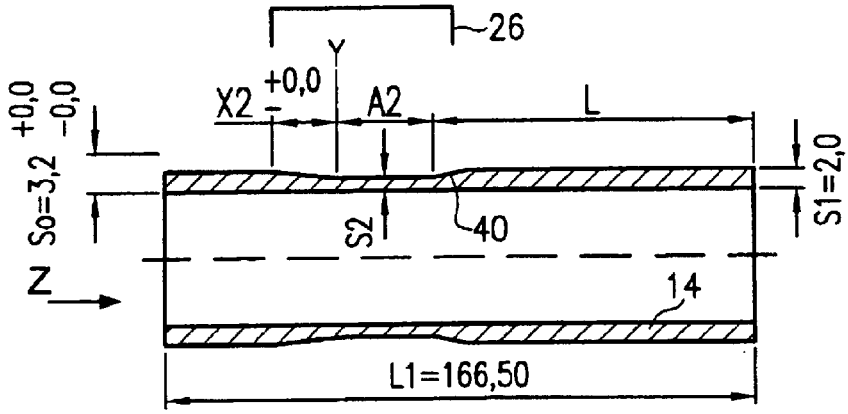
Figure 10:
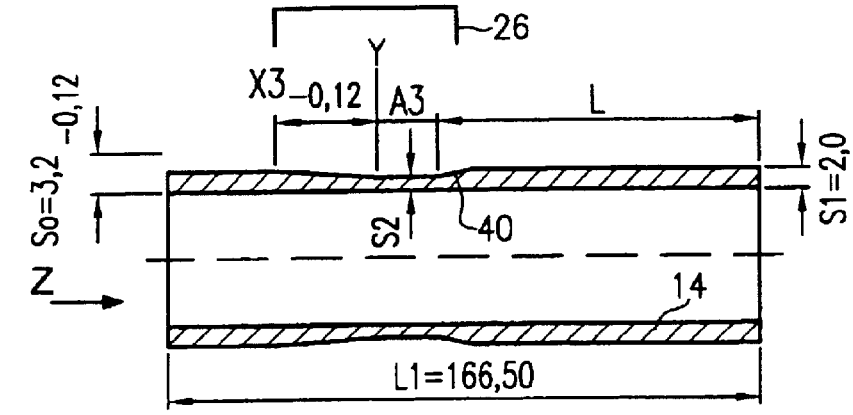

FIGS. 8 to 10 Axial cross-sectional views of further workpieces with individually formed compensating areas.

Figure 11:
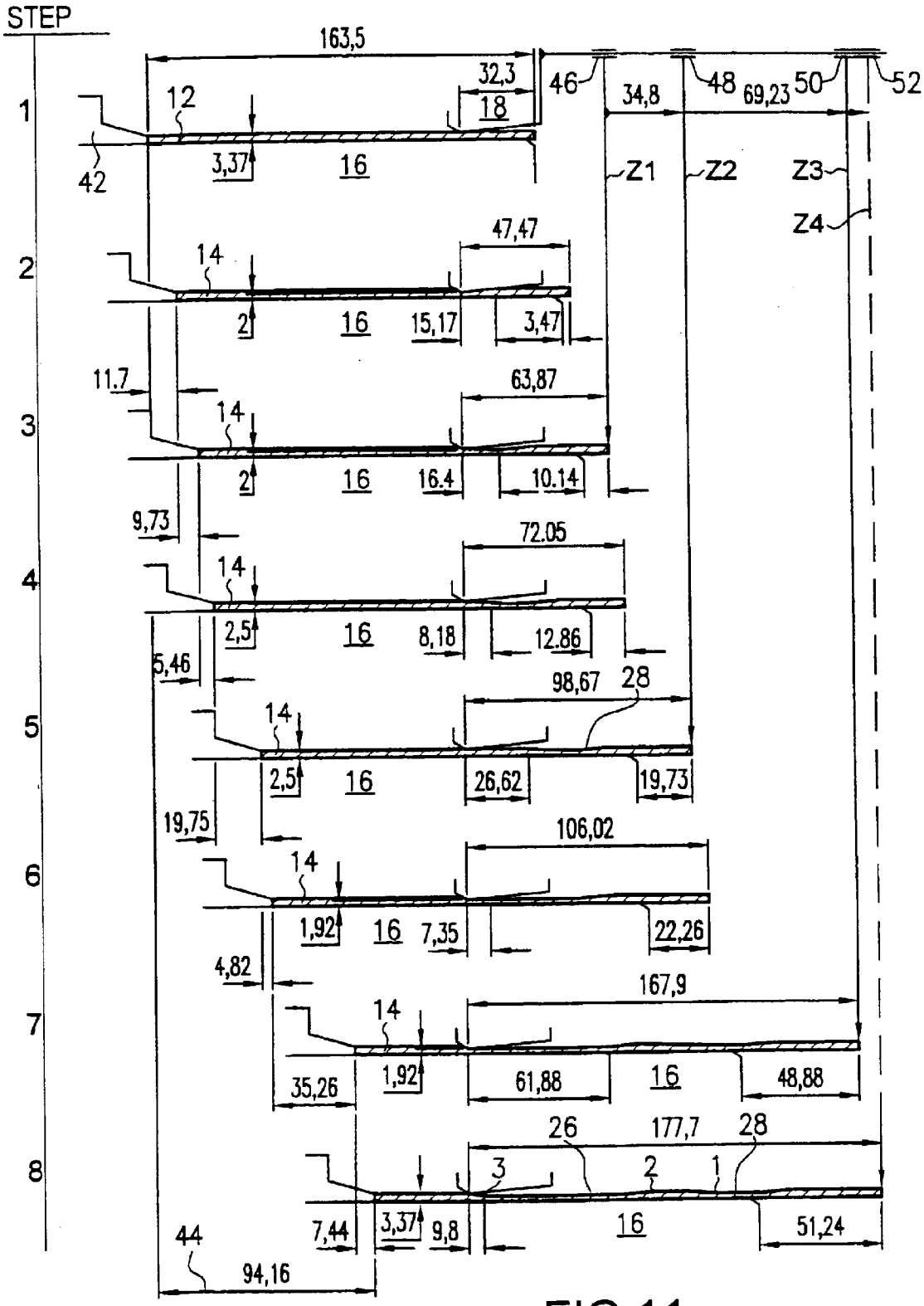

FIG. 11 Diagrammatic part cross-sectional views of a blank or a workpiece and an apparatus according to the invention in different stages of the method according to the invention.

Figure 12:
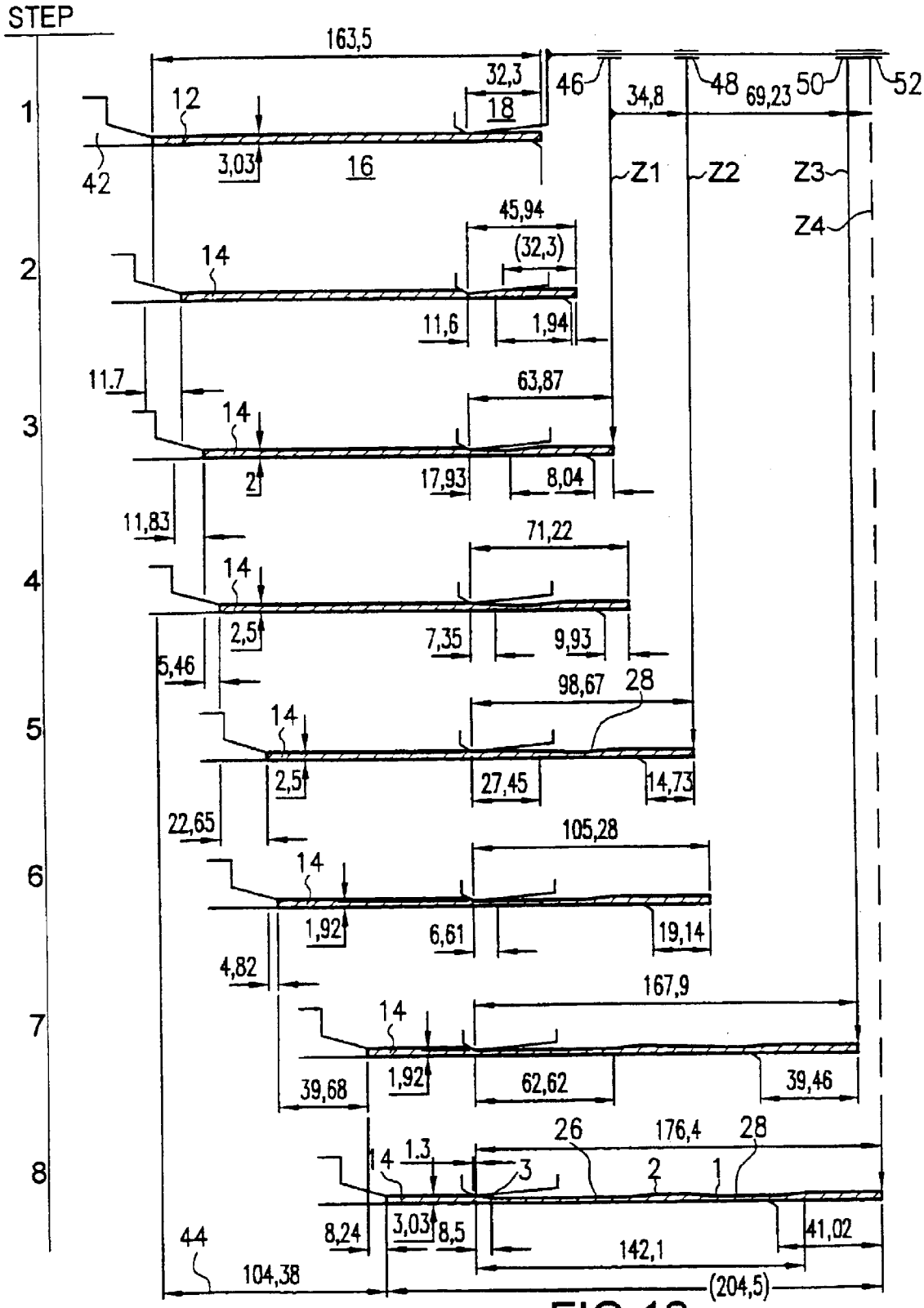

FIG. 12 Diagrammatic part cross-sectional views of a further blank or workpiece and the inventive apparatus of FIG. 11 in different stages of the inventive method.

Figure 13:
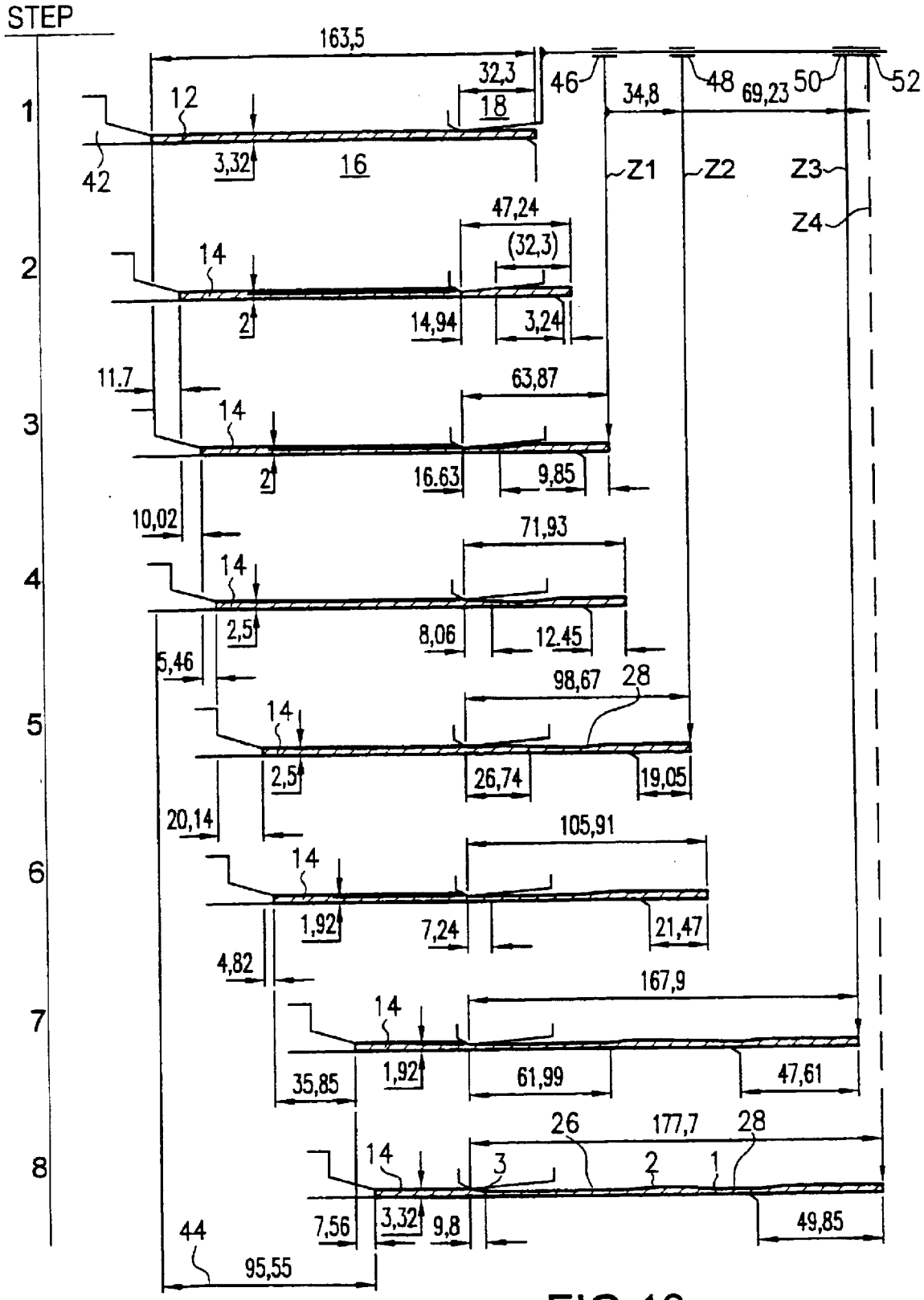

FIG. 13 Diagrammatic part cross-sectional views of a further blank or workpiece and the inventive apparatus of FIG. 11 in different stages of the inventive method.

FIG. 1 shows an axial cross-sectional view of a tubular blank 12 with an axial length Lo, an internal diameter di, an external diameter da and a wall thickness So. The dimensions in the drawings are in millimetres.

The wall thickness So of the blank 12 has a tolerance of ±0.12 mm.

As shown in FIGS. 2 to 4, the tolerance has a drastic effect on an axial length L1 of a finished workpiece 14.

FIG. 2 shows in an axial cross-sectional view a workpiece 14 rolled out of a blank 12 in an axial direction Z. The wall thickness So of the thus used blank 12 was at the lower limit of the tolerance range of FIG. 1.

FIGS. 3 and 4 show in axial cross-sectional views further workpieces 14, in which the wall thickness So of the blanks 12 used were in the middle or upper limit of the tolerance range of FIG. 1.

It can be clearly gathered from FIGS. 2 to 4 that individually present dimensional variations of the blanks 12, in the presently shown case the fluctuation in the wall thickness So, have a very pronounced effect on the geometry, such as on the axial length L1 of the rolled out workpieces 14. For example, the axial length L1 of workpiece 14 in FIG. 2 compared with the workpiece of FIG. 4 differs by 8%.

FIGS. 5 to 7 show axial cross-sectional views of workpieces 14, in which in an area uncritical for the functionality of the workpiece 14 are individually worked compensating areas 26 according to the invention.

The compensating areas 26 in each case have a cylindrical area A, as well as a bevelled area constructed as a runout bevel X1, X2, X3. All the workpieces 14 of FIGS. 5 to 7 have an identically constructed cylindrical area L between the right-hand end of the workpiece 14 in FIGS. 5 to 7 and the compensating area 26. In the case of the workpieces 14 of FIGS. 5 to 7, there is also a cylindrical area A with an identical axial length and an identical wall thickness S2.

For compensating dimensional variations of the blank 12 used, the runout bevels X1, X2, X3 starting from point Y and connected to the cylindrical area A are individually constructed.

For the workpiece 14 in FIG. 6 use has been made of a blank 12, in which the wall thickness So was in the middle of the tolerance range of FIG. 1. However, the workpieces 14 in FIGS. 5 and 6 were flow-formed from blanks 12 with wall thicknesses So at the upper/lower end of the tolerance range of FIG. 1.

In accordance with the wall thickness So of the blank 12 used above the mean value, compared with the axial extension of the runout bevel X2 of FIG. 6, the workpiece 14 in FIG. 5 has a shortened runout bevel X1. In the same way the runout bevel X3 of workpiece 14, for which use was made of a blank with a wall thickness So below the mean value, is lengthened compared with X2.

So that, despite the dimensional variations of the blanks 12, to keep constant the final manufactured length L1 of the workpieces 14, in the manufacture or design of the workpieces 14 or the manufactured parts account was taken of the inventive compensating areas 26, which can also be called tolerance compensating areas. In these compensating areas 26 account is taken of tolerance differences in accordance with the effect thereof on the final manufactured length L1 by measurements during the working or forming process.

A subsequent mechanical machining on the opening diameters can be precisely taken into account in the overall axial length L1.

With the runout bevels X1, X2, X3 shown in FIGS. 5, 6 and 7, at point Y, which always has the same spacing from the right-hand opening diameter, a measurement is carried out on the flow-formed part. Whilst taking account of the displacement path of a spindle in the Z-direction, by means of a volume equation a computer calculates the actual variation and therefore establishes the axial extension of the runout bevels X1, X2, X3.

The volume equation used is based on the volume constancy of the worked material and the constancy of the internal diameter of the workpiece.

Thus, as a result of the inventive working in of individually formed compensating areas 26, workpieces 14 with identical axial lengths L1 are obtained.

Further examples of individually adapted compensating areas 26 are shown in FIGS. 8 to 10. Once again workpieces 14 are shown in axial cross-sectional views which, starting from blanks 12 with different wall thicknesses So, have been manufactured using the method according to the invention.

As in FIGS. 5 to 7, the workpieces 14 each have identical cylindrical areas L to which are in each case connected individually constructed compensating areas 26. Once again the compensating areas 26 comprise a cylindrical area A1, A2, A3 as well as a runout bevel X1, X2, X3 connected thereto after point Y.

Unlike in the case of the workpieces 14 of FIGS. 5 to 7, with the workpieces 14 of FIGS. 8 to 10 both the runout bevels X1, X2, X3 and the cylindrical areas A1, A2, A3 of the compensating areas 26 are individually adapted to the existing dimensional variation of the blank 12 used.

Once again identical axial lengths L1 of the finished workpieces 14 are obtained.

The invention is further illustrated in FIGS. 11, 12 and 13 in connection with examples of the manufacture of weight-optimized wheels produced in the up-feed flow-forming method.

In up-feed flow-forming a blank 12, which can be a bush or a pipe section, is engaged over a rolling mandrel 16 up to a clamping point and is engaged there by a driving ring 42, which can be provided with hardened teeth.

An axial force of one or more flow-forming rolls 18 presses the blank 12 onto a toothed segment and thus gives it a rotary movement. During the working the material flows under the flow-forming rolls 18 in the direction of the free rolling mandrel and into a free working area of the machine. Thus, the longitudinal feed and flow direction oppose one another.

The invention can also be used for spinning and other flow-forming operations. As a function of the particular application, combinations of length, diameter, pressure and temperature measurements are possible.

In FIGS. 11, 12 and 13 are shown parts of an apparatus according to the invention and in part cross-sectional views blanks 12 and workpieces 14 in different stages of the method according to the invention. The blanks 12 of FIGS. 11, 12 and 13 in each case have different wall thicknesses.

Identical components are in each case given the same reference numerals.

The part cross-sectional views regarding method step 1 in each case show a blank 12 located on a rolling mandrel 16 and which can engage with a driving ring 42. The rolling mandrel 16 is then rotated and several flow-forming rolls 18, whereof one is shown in exemplified manner, are radially infed to the blank 12.

Axial infeeding takes place by displacing the rolling mandrel in the Z-direction.

To determine the axial length of the workpiece in different stages of the method according to the invention, on the apparatus are provided several displacement transducers 46, 48, 50, 52. These displacement transducers 46, 48, 50, 52, which can be optical sensors, are arranged in axially spaced manner at positions Z1, Z2, Z3 and Z4.

Firstly with the aid of the flow-forming rolls 18 an area 28 with a reduced wall thickness is worked into the workpiece 14. Through this area 28, together with a compensating area 26 to be subsequently formed, in the finished workpiece 14 an approximately symmetrical weight distribution is obtained.

On the basis of the axial lengths of the workpiece 14 determined by the displacement transducers 46, 48, 50, 52 during flow-forming, according to the invention the geometrical parameters of a compensating area 26 are individually calculated and the flow-forming rolls 18 are axially and radially infed to the workpiece 14 in accordance with the calculated parameters.

During the rolling out of the blank 12 to the finished workpiece 14, the driving ring 42 is infed by a total displacement path in the Z-direction 44 with respect to the flow-forming roll 18.

In method step 1 the flow-forming roll 18 is placed at a distance of 32.3 mm from the right-hand opening diameter. In step 2 a first approach bevel of the area 28 is formed.

In step 3 the flow-forming roll 18 is in a cylindrical portion of the area 28, the displacement transducer 46 as the first measuring point being located at a distance of 63.87 mm from the flow-forming roll 18 at position Z1. A runout bevel of the area 28 is then worked into the workpiece 14.

In step 4 a runout bevel with a length of 8.18 mm is completely worked in. In step 5 the workpiece 14 has reached the second displacement transducer 48 located at position Z2. With a distance of 98.7 mm a first approach bevel of a compensating area 26 starts up to a wall thickness cross-section of 1.92 mm.

In step 6 the workpiece 14 has reached the third displacement transducer 50 at position Z3, which is located at a distance of 167.9 mm from the flow-forming roll 18. Based on the measured distance travelled in the Z-direction and taking account of the measured data of the displacement transducer 50 at position Z3 by means of the volume equation, determination takes place by means of a computer of the parameters for a runout bevel of the compensating area 26, in order to reach a total workpiece length of 204.5 mm. Simultaneously, from the determined data, the position Z4 of a fourth, variably positionable displacement transducer 52 is set.

With the aid of the fourth displacement transducer 52 at position Z4 it is possible to verify a desired axial final length of the finished workpiece 14.

On reaching the fourth displacement transducer 52 at position Z4 in step 7 the flow-forming process is ended and the workpiece 14 has reached its desired length of 204.5 mm.

FIGS. 12 and 13 show the method of the invention in the same way as in FIG. 11 for blanks 12 with different dimensional variations. The method steps 1 to 8 of FIGS. 12 and 13 correspond to those of FIG. 11, so that a detailed description is not provided here.

For the different blanks 12 of FIGS. 11, 12 and 13, which in each case have different starting dimensions, once again workpieces 14 with an identical axial length are obtained.

What is claimed is:

1. Flow-forming method, comprising:

placing a blank on a rolling mandrel of a flow-forming machine;

rotating the blank relative to at least one flow-forming roll;

infeeding the at least one flow-fanning roll relative to the blank; and lengthening the blank axially by the flow-forming roll and flow-formed to a workpiece, wherein for compensating dimensional variations of the blank at least one compensating area is worked into the workpiece;

at least one of before and during flow-forming a measuring device determines geometrical data of at least one of the blank and the workpiece;

for obtaining a desired final geometry of the workpiece, geometrical parameters of the at least one compensating area are individually calculated as a function of the determined geometrical data; and by a control device the infeeding of the flow-forming roll is controlled in accordance with the calculated geometrical parameters of the at least one compensating area, so that a workpiece with a desired final geometry can be formed independently of dimensional variations of the blank.

2. Method according to claim 1, wherein the at least one compensating area is worked into an area of the workpiece that is non-critical for functionality of the workpiece.

3. Method according to claim 1, wherein as the geometrical data a determination of at least one axial length of at least one of the blank and workpiece is determined, at least one time.

4. Method according to claim 1, wherein as the geometrical data a determination of at least one of a diameter and a wall thickness of at least one of the blank and workpiece is determined.

5. Method according to claim 1, wherein at least one of before, during, and after flow-forming a temperature of the workpiece is determined.

6. Method according to claim 1, wherein during flow-forming a pressure is determined in the workpiece.

7. Method according to claim 5, wherein during flow-forming a pressure is determined in the workpiece.

8. Method according to claim 7, wherein at least one of the determined temperature and pressure is used in the calculating of the geometrical parameters of the at least one compensating area.

9. Method according to claim 1, wherein the at least one compensating area is formed as at least one of a cylindrical area and a bevelled area.

10. Method according to claim 1, wherein plural compensating areas are worked into the workpiece.

11. Apparatus for flow-forming comprising:

a rolling mandrel for receiving a workpiece;

at least one flow-forming roll;

a driving device configured to produce a rotation between the workpiece and the at least one flow-forming roll; and a control device configured to control an infeed of relative nature between the rolling mandrel and the at least one flow-forming roll; wherein at least one measuring device is provided for determining geometrical data of the workpiece;

the at least one measuring device is connected to the control device further configured to calculate geometrical parameters of a compensating area worked into the workpiece for individually compensating dimensional variations of the blank; and by the control device the infeed of the at least one flow-forming roll is controlled, so that the compensating area of the workpiece is constructed as a function of the geometrical parameters individually calculated by the control device.

12. Apparatus according to claim 11, wherein the at least one measuring device includes at least one displacement transducer.

13. Apparatus according to claim 12, wherein the at least one measuring device includes plural displacement transducers arranged in an axially spaced manner.

14. Apparatus according to claim 11, wherein the at least one measuring device includes a sensor configured to determine at least one of a diameter of the workpiece and a wall thickness of the workpiece.

15. Apparatus according to claim 11, further comprising a temperature sensor configured to determine a temperature of the workpiece.

16. Apparatus according to claim 11, further comprising a pressure sensor configured to determine a pressure in the workpiece.

* * * * *